US007243577B1

(12) United States Patent
Morris

(10) Patent No.: US 7,243,577 B1
(45) Date of Patent: Jul. 17, 2007

(54) LUG WRENCH HAVING RATCHET ASSEMBLY IN THE SOCKET HEAD

(76) Inventor: Wayne L. Morris, 1872 Hwy. 454, Pineville, LA (US) 71360

( * ) Notice: Subject to any disclaimer, the term of this patent is extended or adjusted under 35 U.S.C. 154(b) by 0 days.

(21) Appl. No.: 11/359,239

(22) Filed: Feb. 21, 2006

(51) Int. Cl.
*B25B 13/46* (2006.01)

(52) U.S. Cl. ..... 81/60; 81/124.4; 81/177.5

(58) Field of Classification Search ..... 81/60–63.2, 81/177.5, 124.4; 192/43.1, 43.2
See application file for complete search history.

(56) References Cited

U.S. PATENT DOCUMENTS 2,465,152 A * 3/1949 Ellison ..... 81/121.1
3,905,254 A 9/1975 Palatnuck et al.
4,063,475 A 12/1977 Perkins
4,630,511 A 12/1986 Shirley
4,733,583 A 3/1988 Lewis
5,613,585 A * 3/1997 Tiede ..... 81/62
5,797,300 A 8/1998 Fairbanks
6,047,617 A * 4/2000 Chen ..... 81/63.1
6,257,104 B1 7/2001 Jarrett
6,260,446 B1 * 7/2001 Hu ..... 81/62
6,662,688 B1 12/2003 Avery
6,951,154 B2 * 10/2005 Hsien ..... 81/60

* cited by examiner

*Primary Examiner*—Hadi Shakeri

(57) ABSTRACT

A lug wrench includes a ratchet-type assembly in at least one end of the wrench whereby lug nuts can be turned in the manner of a lug wrench and a ratchet-type wrench. The ratchet mechanism can be set to lock clockwise movement, counterclockwise movement or both directions which will allow the lug wrench to be operated in a convenient manner.

1 Claim, 4 Drawing Sheets

LUG WRENCH HAVING RATCHET ASSEMBLY IN THE SOCKET HEAD

TECHNICAL FIELD OF THE INVENTION

The present invention relates to the general art of tools, and to the particular field of tools used in conjunction with vehicle tires.

BACKGROUND OF THE INVENTION

Removing a tire from an automobile or similar mobile apparatus is a common task performed routinely everyday. Typically, a tire is mounted to a wheel using lug nuts. A hub cap may be placed over the wheel to cover the wheel for aesthetic purposes. In order to remove a tire for repair or replacement, a tire cover or hub cap may need to be removed to access the lug nuts. A lug wrench is used to remove the lug nuts, and the tire is removed.

A typical lug wrench is shaped in the form of a rigid cross that has handles on each side of the lug wrench. The handles allow for easy application of rotational force on the lug nuts. However, as nearly anyone who has ever removed a tire on the side of a highway knows, removing a tire from an automobile can be a cumbersome process. The driver must loosen the lug nuts to change the tire usually having only a manual lug wrench available. Often a manual wrench cannot be manipulated to apply sufficient torque to break the nuts free. Another difficulty often encountered is that the user in trying to apply sufficient leverage causes the wrench to slip from the nut often damaging the faces of the nut making it even more difficult to remove the nut. Thus, the removal and replacement of a tire can be difficult. For example, the lug nuts can be frozen on the wheel. The use of corrosive salt on highways, over-tightening of lug nuts when the tire is installed, and the tire irons traditionally provided as standard equipment on most vehicles can make tire removal difficult if not impossible. Still further, the ordinary wheel has a plurality, usually five or six, of identical lug nuts secured to studs extending parallel to the wheel axis at equally arcuately spaced positions. These lug nuts are conventionally hexagonal and are usually threaded in an opposite sense from the normal direction of rotation of the wheel with which they are associated to prevent loosening during prolonged periods. Accordingly, rotation of the wheel tends to tighten the nuts, so that they become very tightly secured and require great torque to loosen.

While known prior art devices include providing a lug wrench having a longer moment arm or placing a pipe over the lug wrench handle to effectively increase the moment arm, these devices are characterized in being somewhat larger than the original equipment and do not lend themselves to compact storage in the area provided by the car manufacturer. In addition, a lug wrench having a longer moment arm increases the possibility that the lug can be over tightened on the wheel stud compounding tire replacement problems should the lug be over-tightened, breaking the stud.

Therefore, when it is necessary to remove the outside wheel e.g. when the tire of the outside wheel has gone flat, the driver of the vehicle is faced with the problem of either changing the tire himself with the manual lug wrench, or calling for help. Contrary to what might be believed, the latter choice is often made because of the difficulty in removing the lug nuts of these outside wheels. However, calling for help may involve many difficulties in itself, including finding a telephone, finding help, and waiting for that help to arrive.

For these reasons, many lug nut wrenches have disadvantages. Therefore, there is a need for a simple, reliable hand tool that provides sufficient mechanical advantage for the ordinary person to remove tight lug nuts from vehicle wheels.

While the inventor is aware of several forms of tools that can be used to remove and replace lug nuts, these tools often have a problem in operating efficiently when the lug nut is close to the ground or to some other obstacle. In such instances, the tool must be placed on the nut and rotated, but then must be removed from the nut when the tool encounters the obstacle and then replaced after being repositioned. This is cumbersome and makes the already nettlesome task even more annoying. Therefore, there is a need for a lug nut tool that is easily used and can remain easy to use even if the lug nut is in a difficult-to-reach location.

SUMMARY OF THE INVENTION

These and other disadvantages of the prior art are overcome by the tool embodying the present invention which has a ratchet-type socket which is used in association with a lug wrench and which can be locked to be driven clockwise or counterclockwise as required to loosen or tighten lug nuts and which can also be locked so the tool can be used to rotate lug nuts in both directions when suitable. The ratchet mechanisms are located in the distal ends of the wrench arms so the wrench can be used in its normal manner and still will be able to take advantage of the ratchet mechanisms.

The tool embodying the present invention is thus quite versatile and will allow a user to operate it in a manner that will allow only rotation of the lug nut in one direction or the other or in both directions as required. This will allow the tool to be used in tight places, such as where the tire is very close to an obstruction or to the ground, where ready access to the lug nuts of a wheel is not available while avoiding excessive repetitions in the tire-changing process.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
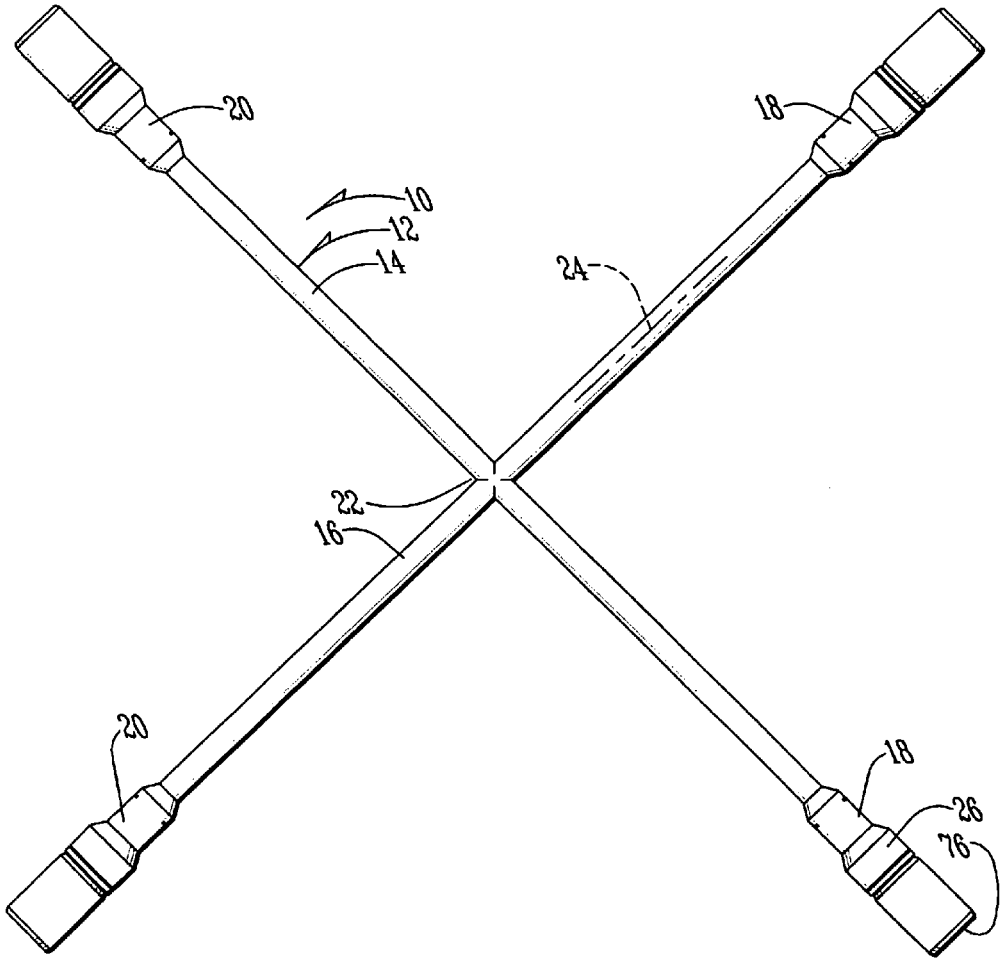
FIG. 1 shows a lug wrench embodying the present invention.

Referring to the figures, it can be understood that the present invention is embodied in a lug wrench 10 which can be used in the manner of a known lug nut wrench or in the manner of a ratchet wrench for tightening or loosening lug nuts.

Wrench 10 comprises a wrench body 12 which has a cruciform shape with a plurality of arms 14 and 16. Each arm includes two distal ends 18 and 20 and a center section 22 with the arms crossing each other at the center section. Each of the arms includes a longitudinal axis 24 which extends between the distal ends of the arm.

In the form shown in FIG. 1, a ratchet housing, such as ratchet housing 26, is located on each distal end and is one piece with the arm to rotate when the arm is rotated. However, it is noted that three of the four distal ends of the wrench could include ratchet mechanisms, while a fourth distal end could include a tire iron or other element without departing from the scope of the present disclosure. A bore 28 is defined in the ratchet housing. The bore has an entrance 30 at the distal end and a base 32. The bore extends from the distal end toward the base and has a longitudinal axis 34 which extends between the distal end and the base and is co-linear with the longitudinal axis of the arm on which the ratchet housing is located. The bore thus opens at the end of the arm and is aligned with the arm.

The ratchet housing has an inner surface 40 and a retainer groove defined 42 defined in the inner surface. A plurality of spine elements, such as spine element 46, are mounted on the inner surface adjacent to the entrance of the bore and extend away from the distal end toward the base. Each spine element extends from inner surface 40 toward longitudinal axis 34 of the bore and has first and second sides 48 and 50 and a top 52 which connects the first and second sides. The spine elements are spaced apart from each other circumferentially about the housing.

Two pivot pin-accommodating bores 60 and 62 are defined in inner surface 40 of the ratchet housing. The pivot-pin-accommodating bores extend in the direction of longitudinal axis 34 of the bore of the ratchet housing and are located between the entrance of the bore and the base of the bore. The function of the bores will be understood from the teaching of the following disclosure.

A ratchet mechanism 70 is mounted on each arm in the ratchet housing. The ratchet mechanisms are all identical; therefore, only one mechanism will be described, it being understood that the following description will apply to each ratchet mechanism. Each ratchet mechanism includes a ratchet head 72 which has a tubular head 74 which has a distal end 76, a base end 78 and a bore 80 which is defined between distal end 76 and base end 78 of the tubular head. A longitudinal axis 82 extends between the distal end of the tubular head and the base end of the tubular head and is co-linear with longitudinal axis 34 of the ratchet housing when the ratchet mechanism is accommodated in the ratchet housing. Head 74 further includes an inner surface 84 which has a plurality of planar surfaces, such as planar surface 86, on inner surface 84. Each planar surface extends from the distal end of the tubular head toward the base end of the ratchet head and is shaped and adapted to engage a flat of a lug nut to turn that nut.

Tubular head 74 further includes an outer surface 88 on the base end of the tubular head and a mounting arm 90 which has a first end 92 fixed to outer surface 88 of the base end of the tubular head, a second end 94 and a longitudinal axis 96 which extends between first end 92 and second end 94 of the mounting arm and which is co-linear with longitudinal axis 34 of the ratchet housing when the ratchet mechanism is accommodated in the ratchet housing. Arm 90 further includes an outer surface 98. A ring 100 is located on outer surface 98 of the mounting arm adjacent to second end 94 and is accommodated in retainer groove 42 defined in the inner surface of an associated arm of the wrench body when the ratchet mechanism is accommodated in the ratchet housing. A plurality of grooves 106 are defined in arm 90 adjacent to first end 92 and extend in the direction of longitudinal axis 96 of the mounting arm.

A selector wheel 120 is rotatably mounted on mounting arm 90 adjacent to base end 78 of the tubular head. Selector wheel 120 includes a first surface 122 which is located adjacent to the outer surface of the base of the tubular head, a second surface 124 and a peripheral surface 126. A plurality of gear teeth 128 are defined in the peripheral surface and will be contacted by the finger or thumb of a user to operate the selector wheel as will be understood from the teaching of this disclosure. Two selector wheel pins 132 and 134 are mounted on second surface 124 of the selector wheel and extend from the second surface of the selector wheel away from the second surface of the selector wheel.

Two cog pin mechanisms 140 and 142 are each pivotally mounted on inner surface 40 of the ratchet housing on which the ratchet mechanism is mounted. Each cog mechanism includes a cog pin element 144 which has a first end 146 located adjacent to one side of a spine element, a second end 148, a first side 150 connecting the first end of the cog pin element to the second end of the cog pin element and a pivot pin 156 on the first side of the cog pin element adjacent to the first end of the cog pin element. The pivot pin of the cog pin element is pivotally mounted in an associated pivot pin-accommodating bore defined in the inner surface of the ratchet housing. The cog pin element pivotally moves between a first orientation with the second end thereof located adjacent to the inner surface of the ratchet housing and a second orientation shown in FIG. 2 with the second end thereof spaced apart from the inner surface of the ratchet housing. The function of this movement will be understood from the teaching of this disclosure.

A spring element 160 is associated with each cog pin and has a first end 162 mounted on the inner surface of the ratchet housing on which the ratchet mechanism is mounted and a second end 164 attached to the cog pin element adjacent to the second end of the cog pin element. The spring element biases the second end of the cog pin element away from the inner surface of the ratchet housing on which the ratchet mechanism is mounted.

The cog pin element is located and positioned with respect to the grooves on the lug nut socket head so that when the cog pin element is in the first position, the second end of the cog pin element engages the lug nut socket head via the grooves to lock the lug nut socket head to the ratchet head via the cog pin, and when the cog pin element is in the second position the second end of the cog pin element is spaced apart from the grooves in the lug nut socket head.

Each of the selector wheel pins is located to slidingly engage one of the cog pin elements between the first and second ends thereof and move the cog pin element against the bias of the spring associated therewith toward the second position to disengage the cog pin element from the grooves in the lug nut socket head when the selector wheel is moved accordingly.

The selector wheel is movable on arm 90 in directions which are clockwise and counterclockwise as indicated by double-headed arrow 170 between a first position in which a first cog pin element is engaged with the grooves of the lug nut socket head, a second position in which a second cog pin is engaged with the grooves of the lug nut socket head, and a third position in which the first and the second cog pin elements are engaged with the grooves of the lug nut socket head.

Figure 2:
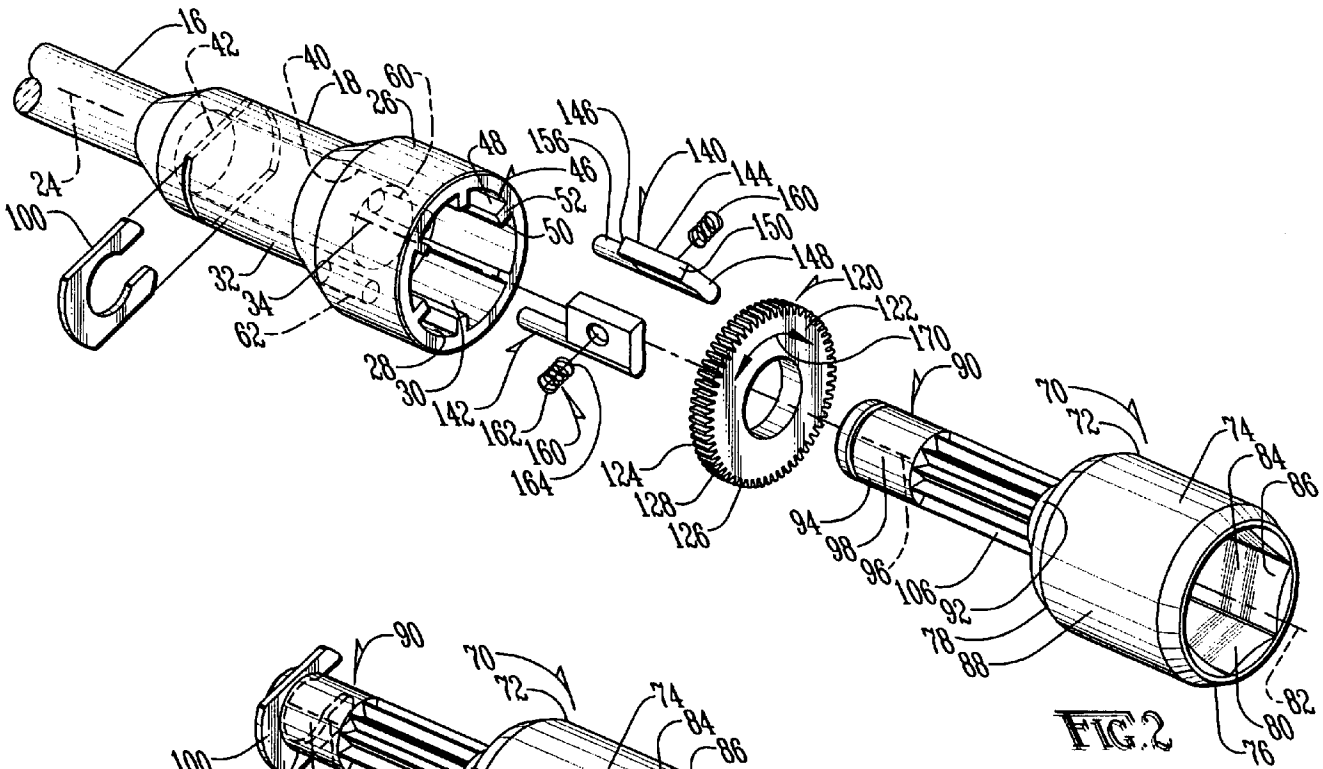
FIG. 2 is an exploded perspective view of one end of the lug wrench embodying the present invention.
Figure 3:
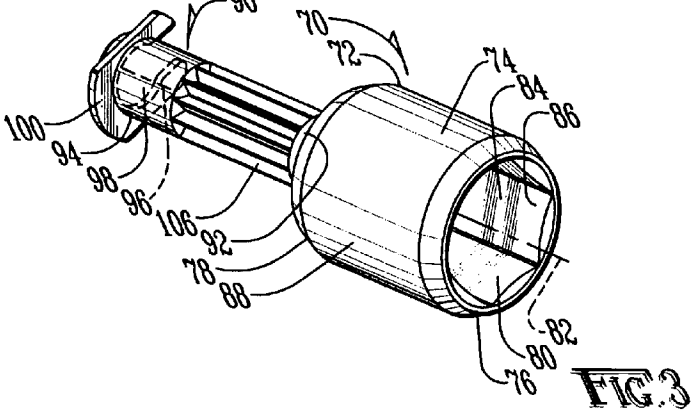
FIG. 3 is a perspective view of lug nut socket head included in the lug wrench embodying the present invention.
Figure 4:
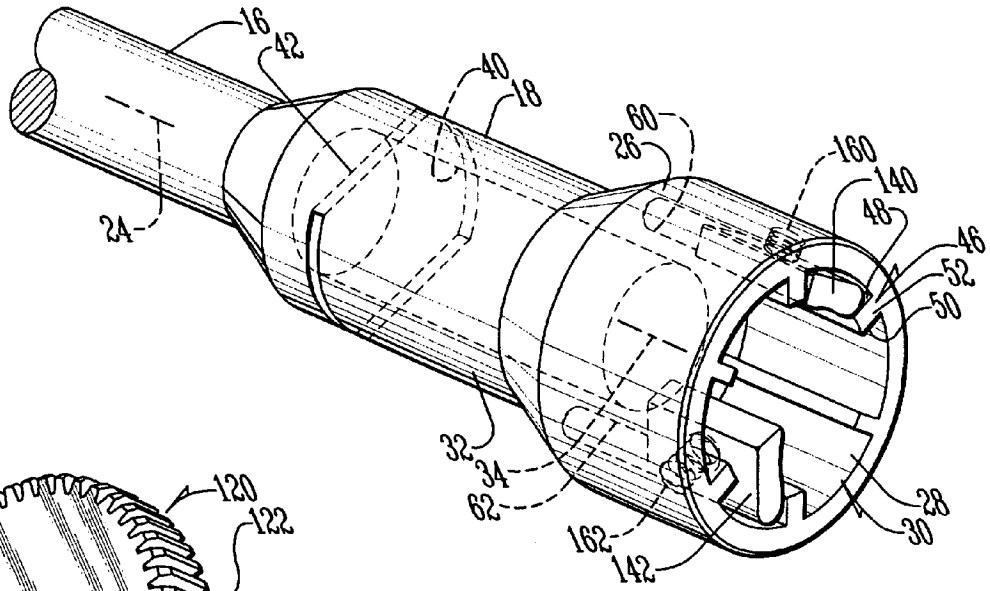
FIG. 4 is a perspective view of a ratchet housing included in the lug wrench embodying the present invention.
Figure 5:
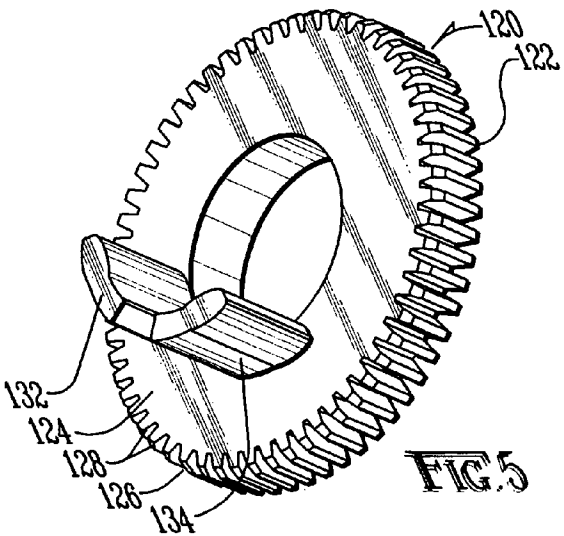
FIG. 5 is a perspective view of a selector wheel included in the lug wrench embodying the present invention.
Figure 6:
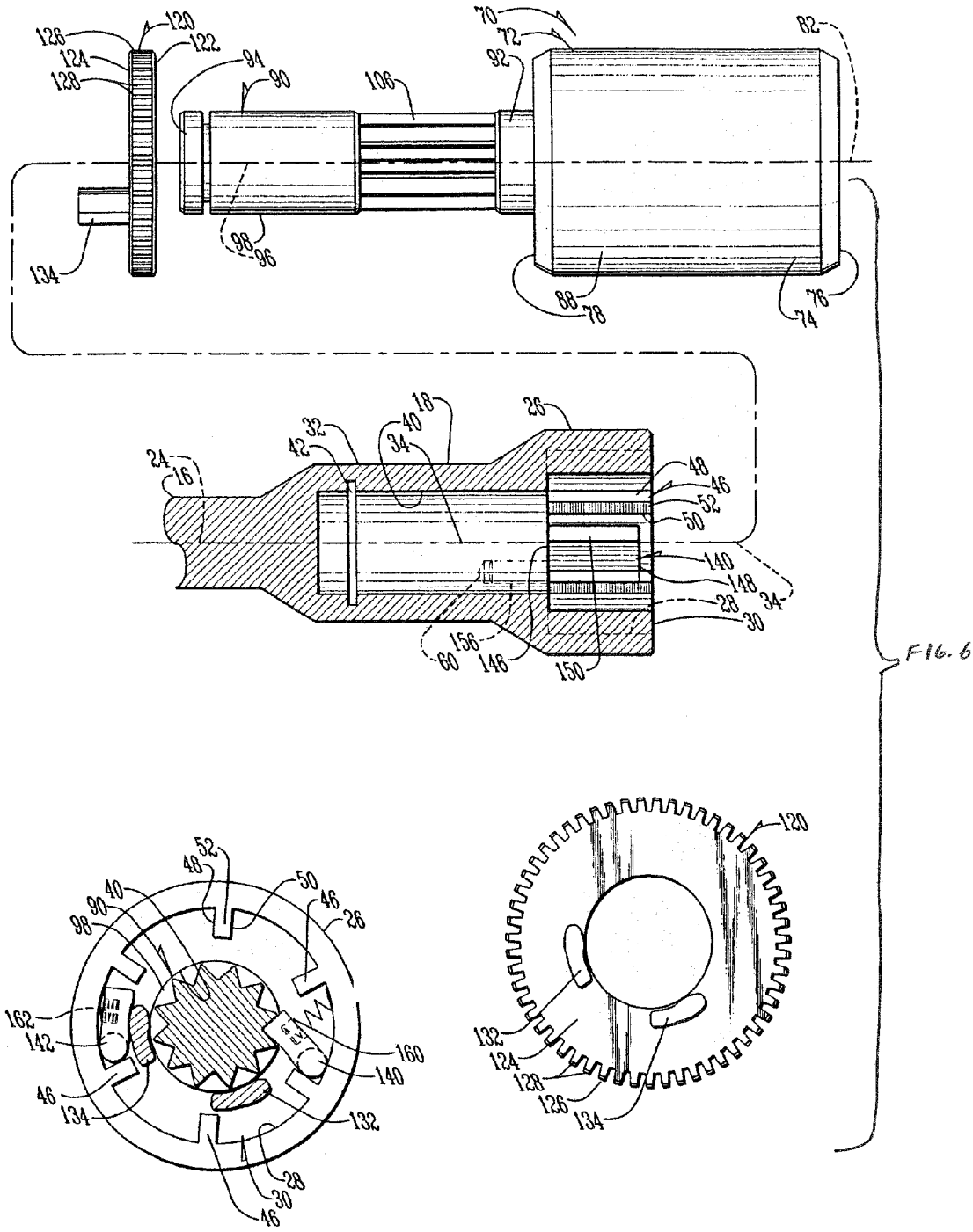
FIG. 6 shows the various parts of the lug wrench embodying the present invention.

As can be understood from FIGS. 2 and 4, second end 148 of first cog pin element 140 is located and oriented to be presented toward the second end of second cog pin element 142 so that when the selector wheel is in the first position thereof the first cog pin element is engaged with the grooves of the lug nut socket head and the second cog pin element is disengaged from the grooves of the lug nut socket head whereby rotation of the wrench in the clockwise direction will be transferred to the socket head but rotation of the wrench in the counterclockwise direction will not be transferred to the socket head and when the selector wheel is in the second position thereof the first cog pin element is disengaged from the grooves of the lug nut socket head and the second cog pin element is engaged with the grooves of the lug nut socket head whereby rotation of the wrench in the clockwise direction will not be transferred to the socket head but rotation of the wrench in the counterclockwise direction will be transferred to the socket head and when the selector wheel is in the third position thereof the first and the second cog pin elements are both engaged with the grooves of the lug nut socket head whereby rotation of the wrench in either the clockwise or the counterclockwise direction will be transferred to the socket head.

As will be understood from the teaching of the foregoing disclosure, if a user wishes to use wrench 10 in a normal manner, the user simply positions the selector wheel so the selector wheel pins are positioned between the elements 140 and 142 so that the springs will bias the elements into engagement with the grooves of the ratchet arm to connect the arm and the ratchet. In this configuration, rotation of the wrench body in either direction will be transferred to a lug nut in the ratchet. If only rotation in one direction is desired, such as when a tire is located adjacent to an obstacle such as the ground and rotation of the wrench will be impeded, the selector wheel is rotated to lock one element away from engagement with the groove and to allow the other element to be spring biased into engagement with the grooves. Since the cog elements are angled as shown in FIGS. 2 and 4, the cog element that is engaged with the grooves will pass over the grooves when the arm is rotated in one direction but will engage the grooves when the arm is rotated in the opposite direction thereby transferring wrench rotation to the ratchet in one direction while permitting overrunning when the wrench is rotated in the opposite direction. Rotation of the selector wheel in the opposite direction will permit rotation of the lug nut in the direction opposite to the just-described rotation. Thus, wrench 10 has three modes of operation: clockwise rotation transfer, counterclockwise rotation transfer and both direction transfer. The cog mechanisms will click into place when they engage the grooves so the user is alerted that the mechanism is ready for use and the mechanisms will be securely held in place due to the spring bias and the torque that is being applied via the wrench.

A ratchet mechanism is located on the distal end of each wrench arm and is oriented to open outwardly from the distal end so wrench 10 can be used in a manner that is similar to presently-available lug nut wrenches. This will allow a user to use wrench 10 in a manner that will not be unfamiliar to him and will also allow the wrench to be used in tight places since the wrench arms can reach the lug nuts even if those lug nuts are located in tight and difficult-to-reach places. Note that it is within the scope of this invention to have the ratchet mechanism in one of the arms rather than all four arms.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A lug wrench comprising:

A) a wrench body which has a cruciform shape with a plurality of arms, each arm including
  (1) two distal ends,
  (2) a ratchet housing on each distal end, the ratchet housings being one-piece with the arms,
  (3) a bore defined in the ratchet housing, the bore having an entrance at the distal end and a base, the bore extending from the distal end toward the base and having a longitudinal axis which extends between the distal end and the base,
  (4) an inner surface on the ratchet housing,
  (5) a retainer groove defined in the inner surface,
  (6) a plurality of spine elements mounted on the inner surface adjacent to the entrance of the bore and extending away from the distal end toward the base, each spine element extending from the inner surface toward the longitudinal axis of the bore and having first and second sides and a top connecting the first and second sides, the spine elements being spaced apart from each other, and
  (7) two pivot pin-accommodating bores defined in the inner surface of the ratchet housing, the pivot-pin-accommodating bores extending in the direction of the longitudinal axis of the bore of the ratchet housing and being located between the entrance of the bore and the base of the bore; and B) a ratchet mechanism mounted on each arm in the ratchet housing, each ratchet mechanism including
  (1) a ratchet head having
    (a) a tubular head having
      (i) a distal end,
      (ii) a base end,
      (iii) a bore defined between the distal end and the base end of the tubular head,
      (iv) a longitudinal axis which extends between the distal end of the tubular head and the base end of the tubular head and which is co-linear with the longitudinal axis of the ratchet housing when the ratchet mechanism is accommodated in the ratchet housing,
      (iv) an inner surface,
      (v) a plurality of planar surfaces on the inner surface, each planar surface extending from the distal end of the tubular head toward the base end of the ratchet head, each planar surface being adapted to engage a flat of a lug nut,
      (vi) an outer surface on the base end of the tubular head, and (vii) a mounting arm having first end fixed to the outer surface of the base end of the tubular head, a second end, a longitudinal axis which extends between the first end of the mounting arm and the second end of the mounting arm and which is co-linear with the longitudinal axis of the ratchet housing when the ratchet mechanism is accommodated in the ratchet housing, an outer surface, a ring on the outer surface of the mounting arm adjacent to the second end and which is accommodated in the retainer groove defined in the inner surface of an associated arm of the wrench body when the ratchet mechanism is accommodated in the ratchet housing, and a plurality of grooves defined therein to extend in the direction of the longitudinal axis of the mounting arm, (2) a selector wheel rotatably mounted on the mounting arm adjacent to the base end of the tubular head, the selector wheel including (a) a first surface which is located adjacent to the outer surface of the base of the tubular head, (b) a second surface, (c) a peripheral surface, (d) a plurality of gear teeth defined in the peripheral surface, and (e) two selector wheel pins mounted on the second surface of the selector wheel and extending from the second surface of the selector wheel away from the second surface of the selector wheel, (3) two cog pin mechanisms pivotally mounted on the inner surface of the ratchet housing on which the ratchet mechanism is mounted, each cog mechanism including (a) a cog pin element having a first end located adjacent to one side of a spine element, a second end, a first side connecting the first end of the cog pin element to the second end of the cog pin element, a pivot pin on the first side of the cog pin element adjacent to the first end of the cog pin element, the pivot pin of the cog pin element being pivotally mounted in an associated pivot pin-accommodating bore defined in the inner surface of the ratchet housing, the cog pin element pivotally moving between a first orientation with the second end thereof located adjacent to the inner surface of the ratchet housing and a second orientation with the second end thereof spaced apart from the inner surface of the ratchet housing, (b) a spring element having a first end mounted on the inner surface of the ratchet housing on which the ratchet mechanism is mounted and a second end attached to the cog pin element adjacent to the second end of the cog pin element, the spring element biasing the second end of the cog pin element away from the inner surface of the ratchet housing on which the ratchet mechanism is mounted, and (c) the cog pin element being located and positioned with respect to the grooves on the lug nut socket head so that when the cog pin element is in the first position, the second end of the cog pin element engages the lug nut socket head via the grooves to lock the lug nut socket head to the ratchet head via the cog pin, and when the cog pin element is in the second position the second end of the cog pin element is spaced apart from the grooves in the lug nut socket head, (d) each of the selector wheel pins being located to slidingly engage one of the cog pin elements between the first and second ends thereof and move the cog pin element against the bias of the spring associated therewith toward the second position to disengage the cog pin element from the grooves in the lug nut socket head when the selector wheel is moved accordingly, (e) the selector wheel being movable between a first position in which a first cog pin element is engaged with the grooves of the lug nut socket head, a second position in which a second cog pin is engaged with the grooves of the lug nut socket head, and a third position in which the first and the second cog pin elements are engaged with the grooves of the lug nut socket head, and (f) the second end of the first cog pin element being located and oriented to be presented toward the second end of the second cog pin element so that when the selector wheel is in the first position thereof the first cog pin element is engaged with the grooves of the lug nut socket head and the second cog pin element is disengaged from the grooves of the lug nut socket head whereby rotation of the wrench in the clockwise direction will be transferred to the socket head but rotation of the wrench in the counterclockwise direction will not be transferred to the socket head and when the selector wheel is in the second position thereof the first cog pin element is disengaged from the grooves of the lug nut socket head and the second cog pin element is engaged with the grooves of the lug nut socket head whereby rotation of the wrench in the clockwise direction will not be transferred to the socket head but rotation of the wrench in the counterclockwise direction will be transferred to the socket head and when the selector wheel is in the third position thereof the first and the second cog pin elements are both engaged with the grooves of the lug nut socket head whereby rotation of the wrench in either the clockwise or the counterclockwise direction will be transferred to the socket head.

* * * * *